US008478117B2

(12) United States Patent
Eisenhauer et al.

(10) Patent No.: US 8,478,117 B2
(45) Date of Patent: Jul. 2, 2013

(54) HEATING DEVICE AND HEAT EXCHANGER

(75) Inventors: Hartmut Eisenhauer, Michelfeld (DE); Elmar Mangold, Zoebingen Unterschneidheim (DE)

(73) Assignee: Stego-Holding GmbH, Schwabisch Hall (DE)

( * ) Notice: Subject to any disclaimer, the term of this patent is extended or adjusted under 35 U.S.C. 154(b) by 570 days.

(21) Appl. No.: 12/738,436

(22) PCT Filed: Oct. 16, 2008

(86) PCT No.: PCT/EP2008/008786

§ 371 (c)(1),
(2), (4) Date: Apr. 16, 2010

(87) PCT Pub. No.: WO2009/052994

PCT Pub. Date: Apr. 30, 2009

(65) Prior Publication Data

US 2010/0220985 A1 Sep. 2, 2010

(30) Foreign Application Priority Data

Oct. 18, 2007 (DE) ..... 10 2007 049 957
Oct. 18, 2007 (DE) ..... 10 2007 049 967
Jun. 25, 2008 (DE) ..... 10 2008 030 212

(51) Int. Cl.
*F28D 7/00* (2006.01)
*F28F 1/30* (2006.01)

(52) U.S. Cl.
USPC ..... 392/496; 392/465; 392/485; 392/486; 392/501; 392/502; 165/182; 165/185

(58) Field of Classification Search
USPC ..... 392/496, 465, 485–6, 488, 501, 502; 165/182, 185
See application file for complete search history.

(56) References Cited

U.S. PATENT DOCUMENTS 7,560,663 B2 7/2009 Schehr
2003/0095795 A1* 5/2003 Birdsell et al. ..... 392/365
2007/0071335 A1 3/2007 Thyagarajan et al.

FOREIGN PATENT DOCUMENTS

DE 102006018784 A1 6/2007
JP 50-148059 U 12/1975

(Continued)

OTHER PUBLICATIONS

English translation of Int'l Preliminary Report on Patentability and Written Opinion issued on May 11, 2010 in Int'l Application No. PCT/EP2008/008786.

(Continued)

*Primary Examiner* — Shawntina Fuqua
(74) *Attorney, Agent, or Firm* — Panitch Schwarze Belisario & Nadel LLP

(57) ABSTRACT

The invention relates to a heating device having a heating arrangement in a housing through which a fluid medium can flow in a longitudinal direction, wherein the at least one heating arrangement comprises at least two grid elements as heat exchanger plates with openings through which the medium flows, the grid planes of which are embodied for the exchange of heat energy between the plate and the fluid medium, at least one heating element, in particular a PTC element, arranged between the grid elements, wherein the at least one heating arrangement is arranged in the housing in such a way that the grid planes of the grid elements are arranged substantially perpendicularly to the longitudinal direction, so that the flow of medium is oriented substantially perpendicularly to the grid planes, wherein the grid elements and the at least one heating element are arranged braced relative to one another by means of at least one tensioning element so that they touch, and wherein the grid elements each have at least one contact region and are arranged in such a way that they absorb the heat energy from the at least one heating element substantially via the contact region.

The heating device can be manufactured in simplified production and at low costs, environmental aspects also being taken into account during operation of the heating device.

17 Claims, 5 Drawing Sheets

FOREIGN PATENT DOCUMENTS

| | | | |
|---|---|---|---|
| JP | 51-007954 | U | 1/1976 |
| JP | 63-058331 | A | 3/1988 |
| JP | 02-045373 | U | 3/1990 |
| JP | 04-005785 | A | 1/1992 |
| JP | 2007-046893 | A | 2/2007 |

OTHER PUBLICATIONS

English translation of an Office Action issued Feb. 21, 2013 in JP Application No. 2010-529291.

* cited by examiner

HEATING DEVICE AND HEAT EXCHANGER

CROSS-REFERENCE TO RELATED APPLICATIONS

This application is a Section 371 of International Application No. PCT/EP2008/008786, filed Oct. 16, 2008, which was published in the English language on Apr. 30, 2009, under International Publication No. WO 2009/052944 A2 and the disclosure of which is incorporated herein by reference.

BACKGROUND OF THE INVENTION

Heating appliances of this type have a wide range of uses, i.e. for example in switch cabinets in order to maintain the electronics contained therein at operating temperature even when the external temperature is low or to avoid corresponding formation of condensate. They are produced at different thermal outputs in large quantities. The commercially accepted price is relatively low; in addition, many known appliances have high power consumption. There is increasing demand for environmentally acceptable products.

Known appliances are expensive and complex to manufacture. In particular, the operating costs are usually high on account of the high power consumption. Environmentally polluting materials are also often used for appliances of this type.

BRIEF SUMMARY OF THE INVENTION

The invention is based on the object of manufacturing heating devices of the type mentioned at the outset in simplified production and at low costs, wherein environmental aspects are also to be taken into account during operation of the heating devices.

This object is achieved by a heating means according to patent claim 1.

In particular, the object is achieved by a heating device comprising at least one heating arrangement, power supply means for supplying power to the heating arrangement, a housing, through which in a longitudinal direction a fluid medium can flow, for receiving the heating arrangement, wherein the at least one heating arrangement comprises at least two grid elements as heat exchanger plates with openings through which the medium flows, the grid planes of which are embodied for the exchange of heat energy between the plate and the fluid medium, at least one heating element, in particular a PTC element, arranged between the grid elements, wherein the at least one heating arrangement is arranged in the housing in such a way that the grid planes of the grid elements are arranged substantially perpendicularly to the longitudinal direction, so that the flow of medium is oriented substantially perpendicularly to the grid planes, wherein the grid elements and the at least one heating element are arranged braced relative to one another by means of at least one tensioning element so that they touch, and wherein the grid elements each have at least one contact region and are arranged in such a way that they absorb the heat energy from the at least one heating element substantially via the contact region.

A key point of the invention consists in the fact the heat exchanger plate used is a grid element allowing, on account of its openings, a high degree of swirling of the medium, for example air, to be achieved as it flows through, whereas the flowing medium can calm down again between the grid elements. This allows the heat output from the heating device to be greatly increased and in this way higher efficiency to be achieved. At the same time, the heating elements are cooled by the exchange of heat and are thus ready for use at all times. In addition, power adjustment is possible by varying the openings, i.e. using various perforated grids or grid elements (size, shape of the openings). It is possible to provide openings of any desired shape, for example diamond-shaped, oval or round openings.

The at least one tensioning element allows grid elements and heating element(s) to be joined together easily and without additional connecting measures, thus providing an optimum transfer of heat from the heating element to the grid elements. It is thus possible to dispense with electrically conductive adhesive connections, for example. The bracing allows the use of higher temperatures than would be possible in the case of adhesive connections. To this extent, the grid elements with the at least one heating element arranged therebetween are a heating arrangement which can be manufactured in a simple manner using few materials and operates efficiently.

On account of the openings in the grid element, the surface area of the heat exchanger plate is increased and in addition the medium is swirled as it flows through, thus allowing an improved output of heat energy to be achieved. After swirling, the medium is stress-relieved and flows in a more laminar fashion toward the next grid element. Swirling and stress relief zones increase the efficiency of the heating device.

The term "longitudinal direction" refers in this case to the direction of the construction of the heating device. The grid elements are arranged one after another in the housing in such a way that the medium can flow successively through them. That is to say, the housing can be flowed through in its longitudinal direction. The longitudinal direction may also be referred to as the z direction.

Preferably, a fan is arranged in the housing for generating the flow of medium. This ensures that enough of the heat energy generated by the heating element or the heating elements is released to the environment.

Preferably, the grid elements are made of electrically conductive material and the power supply means are embodied and arranged on the grid elements in such a way that the at least one heating element is powered via the grid elements. As both heat flows and electric currents flow in the arrangement according to the invention, the arrangement is constructed in such a way that this is enabled in a simple manner without having to provide insulation regions between the heating elements and grid elements (which would impede the heat output or the transfer of heat from the heating element to the grid element). Thus, the path of the current leads to the heating elements via the grid elements; an optimum exchange of heat energy is possible at the same time.

In a preferred embodiment, at least two heating arrangements are provided, the heating arrangements being sandwiched on one another in such a way that the medium successively flows through them. In this case, the heating elements and the at least one tensioning element are arranged in such a way that the heating elements and contact regions are positioned one above another and are braced relative to one another beyond all of the heating arrangements. The grid elements, in particular the contact regions, must have as flat a bearing face as possible for the heating elements, for example PTC elements, in order to achieve the best possible transfer of heat between the heating elements and the grid elements. This is a factor in obtaining as much power as possible from the heating device.

PTC elements are, as previously noted, suitable as heating elements. However, other heating elements can also be provided for this purpose.

That is to say, as the heating arrangements are arranged in the housing one above another in the longitudinal direction, i.e. in the direction of flow, the contact regions are also positioned one above another, the heating elements being provided in each case between the contact regions within a heating arrangement. In the arrangement, care must be taken to ensure that the power supply means are arranged and embodied in such a way that the heating elements, in particular the PTC elements, are connected in parallel, as only in this way is frictionless operation of the heating means ensured.

PTC (positive temperature coefficient) elements conduct the current very effectively at low temperatures, whereas as the temperature rises, their electrical resistance also increases. Therefore, PTC elements are self-limiting, as they switch off at a specific temperature. This prevents overheating.

In one embodiment, at least one spacer, which is preferably embodied in such a way that all the grid elements have substantially the same spacing from one another, is provided between the heating arrangements. The grid elements within a heating arrangement are advantageously set apart from one another by the at least one heating element. Now, the spacer is preferably embodied in such a way that the mutually facing grid elements of the successively arranged heating arrangements are also set apart from one another, the spacing preferably corresponding substantially to the spacing of the grid elements in a heating arrangement. This necessitates providing the arrangement in such a way that a path of the current is guided through the large number of heating arrangements and in this way the supply of power to the heating elements is ensured.

Moreover, electrical requirements of the VDE (Association of German Electrical Engineers) must in any case be adhered to with regard to the spacings. The spacings must also be formed in such a way that zones for calming the flowing medium, as mentioned at the outset, can indeed be formed. The spacing is also defined by the spring which performs the pretensioning, the electrical contact and the corresponding thermal decoupling from the adjacent PTC arranged in series.

One solution according to the invention provides for contact regions to be provided at mutually opposing edges of the grid elements. This allows the contact regions to be arranged for example at two opposing sides. In this way, it is possible to arrange in a sandwich-like arrangement even a large number of heating elements on the contact regions of a grid element so as to form a stable stack of grid elements and heating elements. Furthermore, if appropriate, the spacers are provided, as described hereinbefore, said spacers also being arranged in the region of the contact regions and heating elements in such a way that they help to stabilise the stack.

Preferably, a bridge element or retaining bracket is provided and embodied as the tensioning element in such a way that it surrounds the at least two heating arrangements and braces the grid elements and the heating elements relative to one another. That is to say, the bridge element serves to hold the heating arrangements together, the cohesion between the grid elements and the at least one heating element being ensured by the bridge element even within each heating arrangement. In addition, the bridge element performs—as will be described hereinafter in greater detail—the task of conducting the current.

Even an individual heating arrangement can be surrounded by the bridge element in order to hold the grid elements and the at least one heating element in position and braced relative to one another.

In a preferred embodiment, the bridge element is embodied with spacer elements in such a way that the at least one heating arrangement is fixable in the housing and, set apart from the fan and/or the housing, mountable therein. The spacer elements preferably protrude from the bridge region in such a way that they are supported, for example, against projections in the interior of the housing or are clamped therebetween and thus hold the heating arrangement(s) in position in the interior of the housing. At the same time, the spacer elements can ensure a suitable spacing from other components in the housing, for example from the fan. This enables the bridge element to perform in this case the positioning of the heating arrangement in the housing, thus ensuring functionally appropriate operation of the heating device.

Preferably, the at least one spacer, which is preferably arranged between the heating arrangements, is embodied in a resilient manner to form an additional tensioning element and acts, for example, counter to the bridge element. The spacer is, as described hereinbefore, arranged for example between the heating arrangements in order to ensure a spacing of the heating arrangements. A resilient embodiment allows the grid elements and heating elements all to be braced relative to one another for improved contacting. In addition, the resilient spacer allows, in the case of a relatively rigid bridge element, different possibilities for compensating for the broad range of heating arrangements. Thus, for example, the resilient spacers allow different thicknesses of the grid and/or heating elements or the number thereof to be compensated for within a bridge element. It is also possible to set the tensioning force, for example, i.e. the force with which the components are to be braced relative to one another. Preferably, the spacers are integrated between the heating arrangements in such a way that they contact the adjoining grid elements substantially over the entire contact region in order in this way to achieve uniform bracing (linear contact). The clamping action is also improved by the expansion of the material of the tensioning elements at elevated temperatures.

Furthermore, with regard to the spring in general, it must also be stated that the conveyance of heat to adjacent heating arrangements arranged in series, i.e. for example to the PTCs, is impeded by the linear bearing faces. This increases the performance of the arrangement.

One solution according to the invention provides for the bridge element and/or the at least one spacer to be embodied as power supply means. Operationally appropriate powering of the heating elements, in particular of the PTC elements, can be provided by means of the integration of these elements into the path of the current.

A broad range of types of spring may be used as the spacer, such as for example a simple V-shaped metal sheet, but also coil or plate springs.

It is of course also possible to brace relative to one another the heating arrangements or the elements thereof by means of a tensioning element which attaches to the—viewed in the longitudinal direction—top grid element and presses against the heating arrangements, a non-resilient mating element then being provided on the bottom grid element. The heating arrangements must be set apart from one another in such a way as to prevent short-circuiting.

Preferably, the at least one heating element and/or the grid elements and if appropriate the at least one spacer are mounted in receiving regions of a frame element, the receiving regions being embodied in such a way that the at least one heating element and/or the grid elements and if appropriate the at least one spacer are fixed substantially perpendicularly to the longitudinal direction and arranged so as to be removable in the longitudinal direction, the at least one heating element and if appropriate the at least one spacer resting in the longitudinal direction against the contact region of the grid elements.

That is to say, the components mounted in the one receiving regions (for example the heating element and spacer) are displaceable only in the longitudinal direction (the assumed z direction) and fixed in the x and y directions. This facilitates the installation of the heating means and also the positioning of the heating elements or spacers in the housing.

The region for receiving the grid elements is formed by fixing projections on the frame element, thus allowing the two grid elements surrounding the heating element or elements to be arranged on the frame element in a substantially centred manner. The fixing projections point in the z direction both downward and upward in order to be able to receive both grid elements.

If, as described hereinbefore, the contact regions are provided at two mutually opposing sides or edges on a grid element, for example, then the receiving regions are arranged accordingly in the frame elements, that is to say the receiving regions are also located at two mutually opposing sides or edges of the frame elements. Only in this way is it possible to ensure that the heating elements can contact the contact regions.

Preferably, the frame element is embodied with spacing elements in such a way that the at least one heating arrangement, set apart from the housing, is mountable therein. That is to say, the frame element has projections, for example, which prevent the heating arrangement(s) from approaching the housing wall. This ensures sufficient ventilation and cooling of the heating elements (direct cooling) and at the same time protects the housing from overheating.

Furthermore, the spacing elements serve as an installation guide in order to be able to introduce the installed heating arrangement into the housing for final installation of the heating device. This facilitates the manufacturing process.

The frame element is preferably embodied in such a way that the mutually opposing receiving regions are connected to one another by means of a central strut. The strut helps to stabilise the frame element, including in particular in the bracing of the elements relative to one another, and also serves as an installation and positioning aid. The frame element allows the heating element or elements to be held in the desired position.

In one embodiment, the grid element comprises an expanded metal grid and/or a punched grid. Wall regions, which surround (if appropriate at least partially) the opening in the grid elements, can be oriented at least partially obliquely to the longitudinal direction (as far as the construction of the heating device is concerned). That is to say, the wall regions can not only be oriented parallel to the longitudinal direction, but are tilted relative thereto. It is also possible for the wall regions to protrude beyond the opening upward and/or downward in relation to the longitudinal direction (this will be described hereinafter in greater detail). This provides a higher degree of swirling of the medium as it flows through the grid element than is already provided in a perforated grid anyway. The laminar flow can be "churned up" in grids and in particular in expanded grids or structured grids and thus also the insulating air or medium layers. Swirling ensures that more cold air is conveyed to the heat-emitting faces, thus ultimately allowing increased performance to be achieved.

The wall regions can therefore protrude or elevations which have wall regions, the orientation of which is at least partially oblique in relation to the longitudinal direction, can extend out of the grid plane. As a matter of principle, specifically structured grids (for example elevations in the longitudinal or z direction, for example corrugated and thus plastically structured) allow a high degree of swirling, and thus an increase in the efficiency of the heating device, to be achieved. Expanded metal grids generally have, in particular on account of the oblique face regions, a larger area per se. This allows the medium to be heated for longer without increased flow resistance and at the same time the expanded metal to exert its cooling function more effectively.

Specifically in the case of punched grids, the grid openings may for example be shaped in any desired manner. In expanded metal grids, "distorted" wall regions are often produced by the manufacturing process, such as may be desirable in this case.

In principle, the method itself of manufacturing the expanded metals produces a grid shape which provides to a high degree swirling zones for the air flow (distortion of the openings, for example diamond shape). The grid breaks open laminar air flows and enables in this way much more uniform and more intensive heating of the air flowing through the grids. The flow calms down again between the grids (calming zones) until the flow is churned up again by the nearest grid. This allows the heating power of the arrangement to be increased considerably.

In any case, partial portions (in the grid plane or protruding therebeyond) of the grid elements can be directed obliquely to the surface of the plate and thus to the direction of flow, so that a larger area is available for the exchange of heat and swirling is promoted.

In the case of grids structured plastically (out of the grid plane), particular attention should be paid to the contact regions. Said contact regions must if appropriate be additionally attached to the structured grid element to ensure a flat bearing face.

Expanded metal grids can be manufactured economically, particularly because there is no waste. The grid openings are formed in expanded metals by the punching of cuts and the subsequent deformation of the grid (for example drawing-apart of the cuts). The material-saving method of manufacturing the expanded metals makes them particularly suitable to meet the demand for inexpensive heating devices. Expanded metal has an, if appropriate, corrugated, plastically structured surface (with oblique regions) which promotes swirling. In addition, expanded metal grids display high strength and surface stability.

The grid structures may be adapted to different powers, allowing the throughput of air to be increased or reduced. This influences the abstraction of heat from the heating elements. It is also possible to use PTC elements of differing power.

Advantageously, the grid elements have at least one contact region without openings. This is particularly advantageous in structured grid elements which, on account of their structuring, do not have a uniformly smooth surface and thus also do not have a contact region that would allow the heating elements to rest fully over the entire contact region. In a perforated grid having a planar surface, heating elements can also rest on the perforated region. However, in this case too, an explicit contact region (without openings) improves the transfer of heat.

In a preferred embodiment, the heating elements and the contact regions extend substantially over in each case the entire edge of the grid elements. The largest possible bearing or abutment or contact region is thus utilised for an optimum transfer of heat.

In this way, a large number of heating arrangements may be provided in a heating device, depending on the requirements and size of the heating device. The particular configuration of the heating arrangements thus allows all three dimensions of the heating device to be varied, i.e. the dimensions of the heating device can be altered as required.

WO 2006/058687 discloses an arrangement, a fan heater, in which the subject matter according to the invention as described in the present document can also be applied.

It will be clear from the foregoing that the invention also includes a heat exchanger with a heat source or cold source and at least one heat exchanger plate.

Heat exchangers are used, for example, for the utilisation of waste gas or waste air heat or very generally for heating or cooling the air in air conditioning systems. For example, the temperature of switch cabinets containing sensitive electrical or electronic components may be adjusted to a suitable degree using a heat exchanger.

The design of most known heat exchangers makes them inefficient, so that energy which is present cannot be sufficiently utilised. In addition, the commercially accepted price is relatively low.

The heat exchanger element is a universally usable, standalone unit which can be integrated, with any desired powers and dimensions, into a broad range of appliances and arrangements.

It should also be possible to manufacture heat exchangers in simplified production and at low costs, wherein high efficiency is to be achieved.

A heat exchanger of this type is described in claim 18 and comprises the following:

at least one heat or cold source for generating heat energy, and also at least one heat exchanger plate, the surface of which is embodied for the exchange of heat energy between the plate and a surrounding fluid medium, wherein the heat exchanger plate comprises an expanded metal grid, with openings through which the medium flows, the at least one heat exchanger plate being arranged in such a way that the flow of medium is oriented substantially perpendicularly to the surface of the heat exchanger plate.

The surface is substantially the area forming the grid plane.

A grid element, namely an expanded metal grid, is provided as the heat exchanger plate that allows, on account of its openings, a high degree of swirling to be achieved of the medium, for example air, as it flows through. This allows the heat output or cooling effect of the heat exchanger to be significantly increased and thus higher efficiency to be achieved.

In addition, power adjustment is possible by varying the openings, i.e. the use of various expanded metal grids or grid elements (size, shape of the openings). It is possible to provide openings of any desired shape, for example diamond-shaped, oval or round openings.

Expanded metal grids can be manufactured economically, particularly because there is no waste. Expanded metal has an, if appropriate corrugated, plastically structured surface (with oblique regions) which promotes swirling. In addition, expanded metal grids display high strength and surface stability.

The openings in the expanded metal grid increase the surface area of the heat exchanger plate and also cause swirling of the medium as it flows through, so that an improved transfer of heat is achievable. After swirling, the medium is stress-relieved and flows onward in a more laminar fashion, carrying the corresponding heat energy with it as it goes. Swirling and stress relief zones increase the efficiency of the heat exchanger.

It should be noted that the term "heat energy" also includes the term "cold energy" and the term "transfer of heat" includes the term "transfer of cold". The term "heat energy", as used hereinafter, therefore refers both to the corresponding heat energy and to cold energy.

Preferably, wall regions, surrounding the openings, of the at least one expanded metal grid are oriented at least partially obliquely to the direction of flow. Alternatively or additionally, the openings can also each at least be surrounded by an elevation which extends from the grid plane in the direction of flow and is oriented at least partially obliquely to the direction of flow. In any case, partial portions (in the grid plane or protruding therebeyond) of the heat exchanger plate, which comprises an expanded metal grid, can be directed obliquely to the surface of the plate and thus to the direction of flow, so that a larger area is available for the exchange of heat and swirling is promoted.

Expanded metal grids generally have, (simply on account of the openings, but) in particular on account of the oblique face regions, a greater area per se. This allows the medium to be heated or cooled for longer without increased flow resistance on account of the larger contact area. In addition, specifically with expanded grids or structured grids (grids having at least partially a non-planar, for example corrugated, surface) having oblique regions, the laminar flow, and thus also the insulating air or medium layers, can be "churned up". Swirling ensures that even more substantially unheated or uncooled medium can be conveyed to the heat exchanger plate and thus ultimately an increased performance of the heat exchanger can be achieved. After the churning-up of the laminar flow, the heated or cooled air can then be stress-relieved again and conveyed onward uniformly.

In the case of a heat exchanger having a heat source, said heat exchanger and said heat source are preferably embodied as PTC elements. PTC (positive temperature coefficient) elements conduct the current very effectively at low temperatures, whereas as the temperature rises, their electrical resistance also increases. Therefore, PTC elements are self-limiting, as they switch off at a specific temperature. This prevents overheating.

Preferably, the at least one heat exchanger plate has at least one contact region and is arranged in such a way that it absorbs the heat energy from the heat source or cold source substantially via the contact region. As the at least one heat source or cold source is intended to contact the expanded metal grid over the largest possible area for a good transfer of heat, the contact regions should be embodied in as planar a manner as possible. In the case of expanded metal grids, in particular having the above-described elevations, it is possible to provide for this purpose a separate, in particular non-perforated, region allowing contacting with the heat source or cold source. The plate and heat source or cold source are thus sandwiched on one another.

One embodiment provides at least two heat exchanger plates arranged in such a way that the medium successively flows through them, the at least one heat source or cold source being arranged between the two heat exchanger plates. This enables the heat source or cold source (or else the plurality of elements) to emit the heat energy both to the top grid and to the bottom grid in order in this way to increase the performance of the heat exchanger. The two plates then form with the at least one heat source or cold source arranged therebetween a heat transfer arrangement.

Preferably, at least one tensioning element is embodied and arranged in such a way that the heat exchanger plate or plates and the at least one heat source or cold source are arranged braced relative to one another so that they touch. In this way, it is for example possible to provide a bridge element which surrounds the at least one heat exchanger plate and the at least one heat source or cold source and in this way ensures cohesion and good contacting between the plate and heat source or cold source.

The at least one tensioning element allows grid elements and heat source(s) to be joined together easily and without additional connecting measures, thus providing an optimum transfer of heat from the heat source or cold source to the grid elements. It is thus possible to dispense with adhesive connections, for example. The bracing allows the use of higher temperatures than would be possible in the case of adhesive connections.

In order to increase the performance of the heat exchanger, two heat transfer arrangements can be sandwiched on one another, so that the medium flows through the two arrangements one after the other. In order to provide appropriate swirling and stress relief zones, the arrangements can be arranged set apart from one another, the flow of medium striking the grid planes substantially perpendicularly. The tensioning element (for example a bridge element) can then surround both arrangements. The spacing between the two heat transfer arrangements can be provided by at least one spacer which is preferably embodied as a further tensioning element, for example a V-shaped metal sheet, and counteracts the bridge element. This provides a uniform bracing of the heat sources or cold sources with the heat exchanger plates, thus ensuring an optimum transfer of heat.

In order to ensure the most uniform possible transfer of heat from the heat source or cold source to the expanded metal grid, two contact regions are preferably provided that are arranged at two mutually opposing edges of the heat exchanger plate(s). Accordingly, a large number of heat sources or cold sources can be arranged to form a stable stack of heat exchanger plates and heat sources or cold sources, the sources and the contact regions being positioned one above another. The formation of stable stacks is relevant above all in heat transfer arrangements in which a heat or cold source is arranged between two grids. It is therefore then possible to arrange at least two heat sources or cold sources on the expanded metal grid (or else on a). This also allows the efficiency of the heat exchanger to be increased.

In a preferred embodiment, the at least one heat source or cold source and/or the at least one expanded metal grid are mounted in receiving regions of a frame element, the receiving regions being embodied in such a way that the at least one heat source or cold source and/or the expanded metal grid are fixed substantially perpendicularly to the direction of flow and arranged so as to be removable in the direction of flow and the at least one heat source or cold source resting in the direction of flow against the contact region of the at least one expanded metal grid.

That is to say, the components mounted in the receiving regions are displaceable only in the direction of flow (the assumed z direction) and fixed in the x and y directions. This facilitates the installation of the heat exchanger and also the positioning of the heat source or cold source and the plates.

The region for receiving the expanded metal grid or grids, i.e. for receiving the heat exchanger plates, is formed by fixing projections on the frame element, thus allowing the expanded metal grid or grids (which surround the heat source or cold source or sources) to be arranged on the frame element in a substantially centred manner. The fixing projections point in the z direction both downward and upward in order to be able to receive two grid elements.

If, as described hereinbefore, the contact regions are provided at two mutually opposing sides or edges on a grid element, for example, then the receiving regions are arranged accordingly in the frame elements, that is to say the receiving regions are also located at two mutually opposing sides or edges of the frame elements. Only in this way is it possible to ensure that the heat sources or cold sources can optimally contact the contact regions.

Preferably, power supply means are embodied and provided in such a way that the at least one heat source (if appropriate also a cold source) can be supplied with power via the at least two heat exchanger plates.

In particular, the PTC elements may easily be supplied with power in this way. For this purpose, a respective connection of the power supply means to a respective expanded metal grid is attached in such a way that the PTC elements are connected in parallel (only in this way is functionally appropriate operation thereof ensured). If two heat transfer arrangements are provided, then the tensioning elements (the bridge element and spacer) can be embodied in an electrically conductive manner and form a part of the power supply means. The bracing of the elements relative to one another not only ensures an optimum transfer of heat, but also defines a path of the current.

It is of course also possible to supply the heat sources and if appropriate also the cold sources with power directly. Alternatively, the elements, for example the cooling sources, are provided as cooling hoses and are cooled outside the heat transfer arrangement, for example in an air conditioning system.

Peltier elements may for example also be used as heating or cooling elements.

All types of heat or cold-supplying elements can be used with the expanded metal grids as heat exchanger plates. Thus, for example, heating or cooling hoses can also interact with the plates. In any case, a medium to be heated or cooled may be conveyed in any manner to the heat exchanger plates.

The heat exchangers according to the invention allow heat energy to be transferred in an efficient manner, the heat transfer arrangement being made of environmentally friendly materials.

Further embodiments of the invention emerge from the sub-claims.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
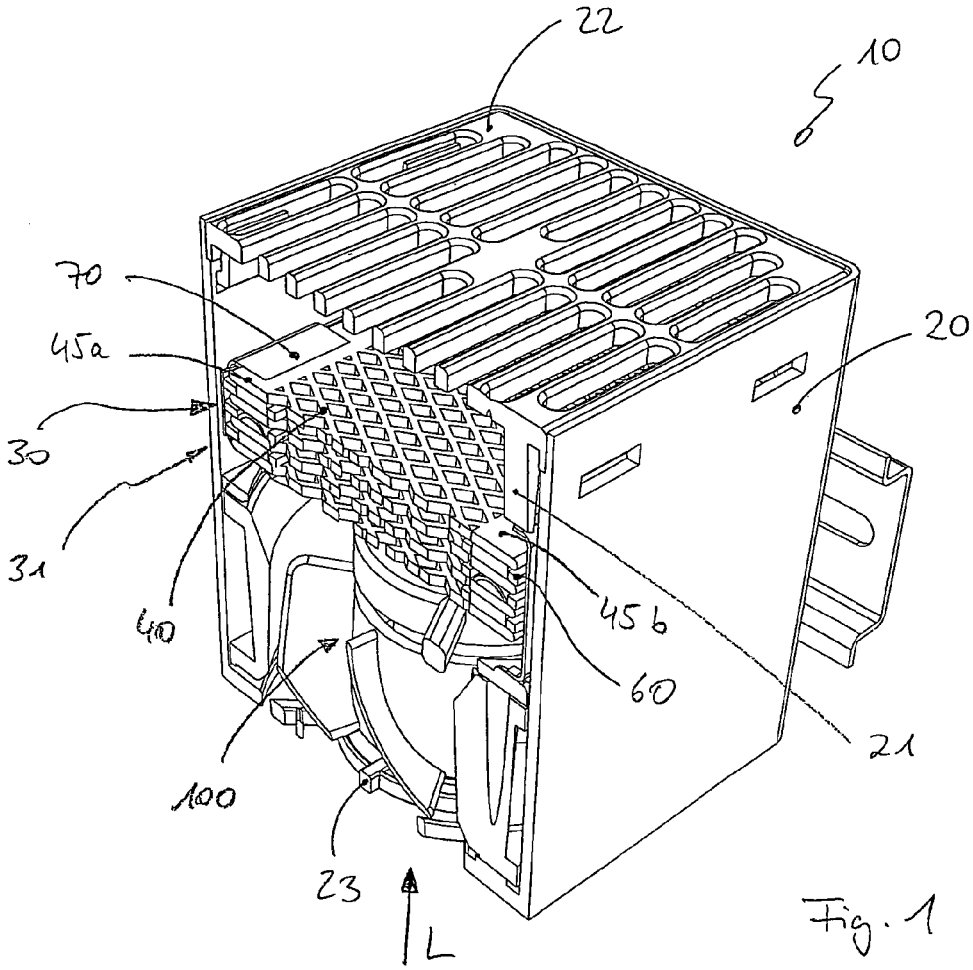
FIG. 1 shows an embodiment of the heating device according to the invention, a perspective view with a cut-open housing being shown.

The same reference numerals will be used hereinafter for like and equivalent parts.

It should be noted that a large number of heating arrangements, grid elements, frame elements, bridge elements and spacers are each provided with their own reference numeral. The other elements, such as for example the openings in the grid elements, contact regions, edges, heating elements, receiving regions, etc. are each denoted only for one plane (i.e. for a grid element or a frame element), so that the figures should not become cluttered. The details designated for a heating arrangement or for a grid element or a frame element may also be found in the second heating arrangement or in the further grid or frame elements.

FIG. 1 is a perspective view of an embodiment of the heating device 10 according to the invention. A sectional view is shown in this case. The heating device 10 comprises a housing 20 receiving substantially heating arrangements 30, 31 and a fan 100 to generate a flow of medium. The fluid medium can flow through the housing 20 in a longitudinal direction L. For this reason, said housing has both at an upper side and at an underside a protective grid 22, 23 through which the flow of medium can be passed and which at the same time prevent intervention into the interior of the housing. The fan 100 draws in ambient air via the underside of the housing 20 and through the protective grid 23 at the underside (which may be seen more clearly in FIG. 5), for example, and conveys said ambient air into the environment through the heating arrangements 30, 31 and the protective grid 22 at the upper side of the housing 20.

The heating arrangements 30, 31 for generating the required heat energy are arranged in the longitudinal direction L above the fan 100, i.e. in the direction of the upper side of the housing. The heating arrangements 30, 31 will be described in greater detail with reference to FIGS. 2 and 3. As may be seen from the exploded view according to FIG. 2 and as is also shown in FIG. 1, two coupled-together heating arrangements 30, 31 are provided here. The heating arrangements 30, 31 are sandwiched on one another in such a way that the medium successively flows through them.

A heating arrangement 30 or 31 comprises at least two grid elements 40, 41 or 42, 43 provided as heat exchanger plates. The grid elements 40, 41 or 42, 43 have openings 44 through which the medium can flow in order, for example, to release (in heated form) the air drawn in by the fan 100 back into the environment through the housing 20. For the exchange of heat energy between the plate and the fluid medium, the grid elements 40, 41 or 42, 43 or the grid planes 46 are embodied and arranged in the housing in such a way (see also FIG. 1) that the grid planes 46 of the grid elements 40, 41 or 42, 43 are arranged substantially perpendicularly to the longitudinal direction L, so that the flow of medium is oriented substantially perpendicularly to the grid planes 46.

Heating elements 50*a*, 50*b*, 50*c*, 50*d*, which can emit the generated heat to the grid elements 40, 41, 42, 43, are arranged in each case between the two grid elements 40, 41 or 42, 43. The heating elements 50*a*, 50*b*, 50*c*, 50*d* are in this case preferably PTC elements. As may be seen from FIG. 2, the PTC elements are mounted in a quadrilateral frame element 60 or 62 in such a way that they can touch with their surfaces the grid elements in the longitudinal direction L and are fixed in all other directions, substantially perpendicularly to this longitudinal direction L. In order to secure the heating elements 50*a*, 50*b*, 50*c*, 50*d*, the frame elements 60, 62 have receiving regions 63*a*, 63*b* which are connected to one another by a central strut 65. The receiving regions 63*a*, 63*b* are arranged at mutually opposing edges 67*a*, 67*b* of a respective frame element 60, 62, so that each frame element can receive at least two heating elements. In this case, standard PTC elements are used, so that in a receiving region two respective PTC elements 50*a*, 50*b* and 50*c*, 50*d*, and thus a total of four elements 50*a*, 50*b*, 50*c*, 50*d*, are accommodated in each frame element 60, 62.

In this embodiment, the grid elements 40, 41, 42, 43 have non-perforated regions, namely contact regions 45*a*, 45*b*, via which the heating elements 50*a*, 50*b* and 50*c*, 50*d* respectively rest against the grid elements 40, 41, 42, 43. The contact regions 45*a*, 45*b* oppose one another—in accordance with the receiving regions 63*a*, 63*b* of the frame elements 60, 62—at two edges 47*a*, 47*b* of the grid elements, so that the heating elements can contact the contact regions. Thus, the heat energy from the heating elements 50*a*, 50*b* and 50*c*, 50*d* respectively is transferred to the grid elements 40, 41, 42, 43 substantially via the contact region 45*a*, 45*b*, the heating elements being at the same time cooled via the grid elements.

Figure 7:
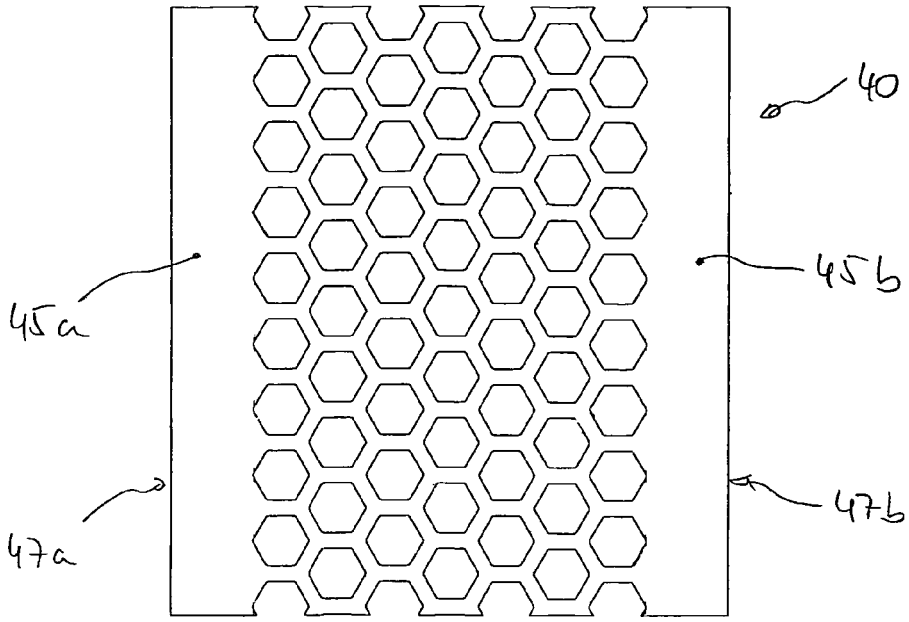
FIG. 7 shows by way of example a grid element with contact regions.

In the exemplary embodiment shown in this figure, the grid elements 40, 41, 42, 43 are embodied as a simple perforated grid, such as is shown by FIG. 7. In grids having a flat surface, as in the example shown, the contact regions 45*a*, 45*b* could also be embodied in a perforated manner, as the heating elements 50*a*, 50*b*, 50*c*, 50*d* always rest flat on the grid element. With the use of structured grids, i.e. grid elements having elevations in the longitudinal direction, for example, non-perforated, flat contact regions are expedient in order to ensure uniform abutment of the heating elements. The elevations around the openings are for example provided in expanded metal grids, wherein the structuring can be generated using the process of manufacturing the grid, for example. In punched grids, the openings can also be surrounded by deformed material (induced by the process of producing the openings), the material then protruding from the grid plane in the longitudinal or z direction L. In expanded grids, any elevations can easily be produced. These elevations increase the degree of swirling of the medium as it flows through, thus allowing the efficiency of the heating device to be increased. Particularly good swirling can be achieved when the elevations have wall regions which are directed at least partially obliquely in relation to the longitudinal direction of the arrangement. The openings themselves can also be surrounded (in the grid plane) by wall regions, the orientation of which is at least partially oblique.

The openings 44, in particular with oblique wall regions in the grid plane 46 and/or at elevations which are embodied around the openings 44 and protrude from the grid plane 46 and the adjoining, barrier-free space (if appropriate up to the next grid element) allow the construction of swirling and stress relief zones for the flow of medium that greatly increase the efficiency of the heating device. That is to say, after swirling, the flow of medium calms down and can then be conveyed onward in a substantially laminar fashion with altered heat energy.

The frame elements 60, 62 have at the sides or edges on which no heating elements are arranged fixing projections 64 which define a further receiving region 63*c* for the grid elements 40, 41, 42, 43 too. The fixing projections 64 extend in the longitudinal direction L both downward and upward, thus allowing both grid elements to be fixed to the frame element.

Furthermore, the frame element 60, 62 has—in this case in the four corner regions—spacing elements 66*a*, 66*c*, 66*d* (a fourth spacing element is not visible here), so that the heating arrangements 30, 31, set apart from the housing 20, are mountable therein. The spacing elements 66*a*, 66*c*, 66*d* further serve as installation aids in order to be able to insert the heating arrangements 30, 31 into the housing more easily.

Figure 2:
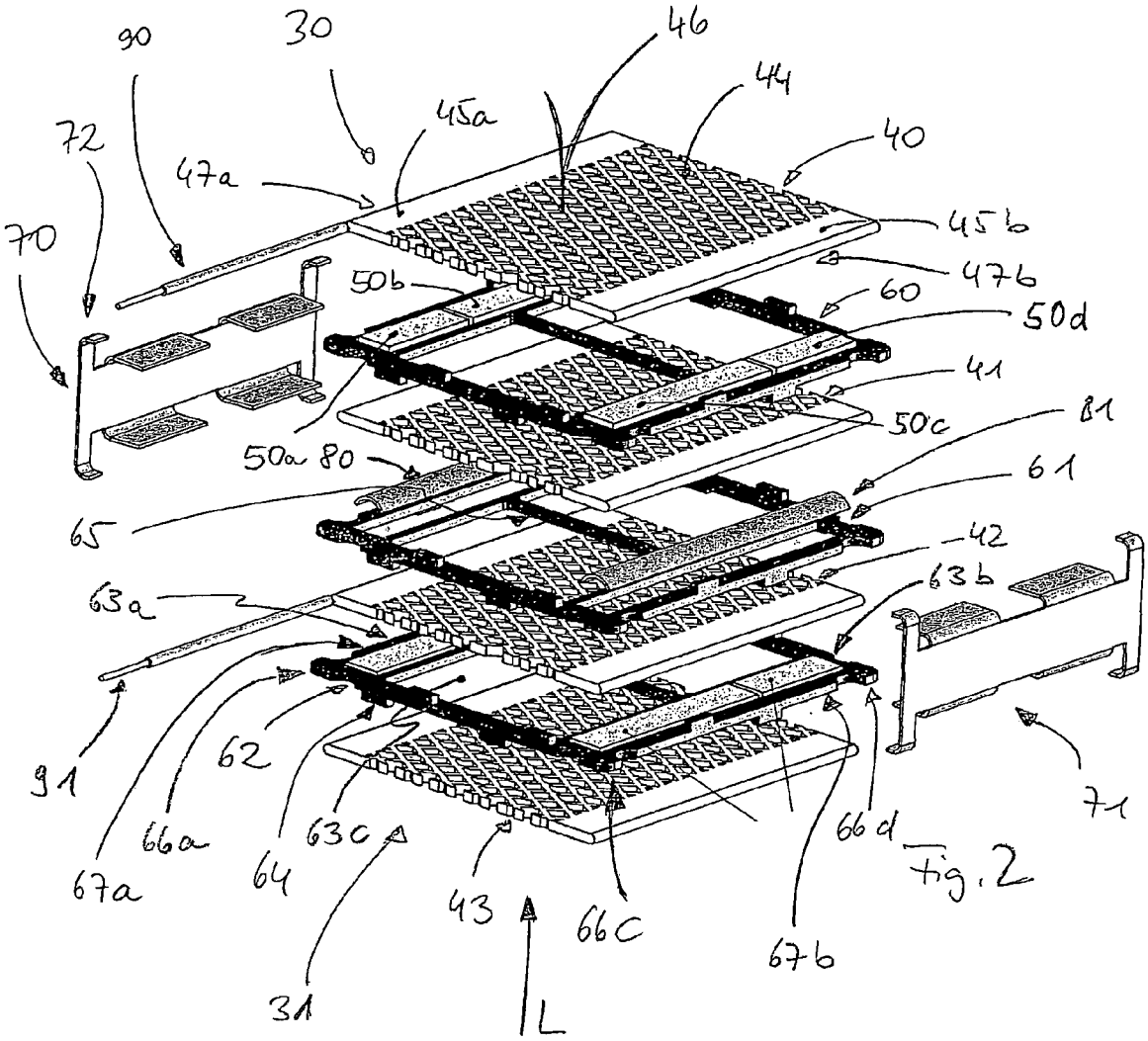
FIG. 2 is an exploded view of the heating arrangement according to the invention, such as is provided in the embodiment as shown in FIG. 1.

As may also be seen from FIG. 2, a further frame element 61 is arranged between the two heating arrangements 30, 31. On the one hand, this frame element 61 fixes the two adjoining grid elements 41, 42 of the two heating arrangements 30, 31 via the fixing projections 64; on the other hand, spacers 80, 81 are secured via the two regions 63*a*, 63*b* for receiving the heating elements. That is to say, spacers 80, 81 are in this case provided instead of the heating elements, so that the two heating arrangements 30, 31 are arranged set apart from one another.

Figure 3:
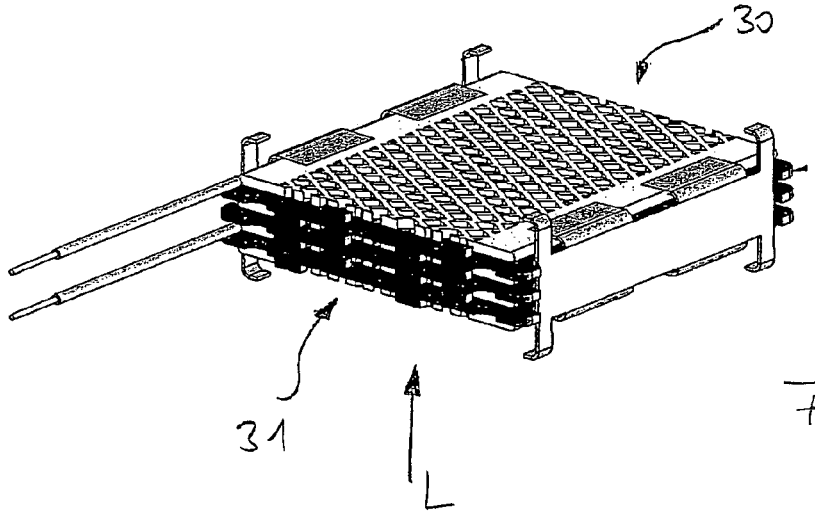
FIG. 3 shows the heating arrangement according to FIG. 2 as a fully installed component.

Two bridge elements 70, 71 enclose the two heating arrangements 30, 31—as may be seen in particular from FIG. 3—at in each case mutually opposing sides on which the contact regions 45*a*, 45*b* are also provided, with a type of gripper arms. The bridge elements 70, 71 are embodied as tensioning elements in such a way that they surround the at least two heating arrangements 30, 31 and brace the grid elements 40, 41, 42, 43 and the heating elements 50*a*, 50*b*, 50*c*, 50*d* relative to one another (press them together) in each of the frame elements 60, 62.

(In this case four) spacer elements 72 extend out of the bridge region, so that the heating arrangements 30, 31 are fixable in the housing 20 and, set apart from the fan 100 and if appropriate also from the housing 20, mountable therein. For this purpose, projections 21, against which the spacer elements 72 are supported or are clamped therebetween and thus hold the heating arrangement(s) 30, 31 in position in the interior of the housing 20, are provided in the housing 20. At the same time, the spacer elements 72 can ensure a suitable spacing from other components in the housing 20, for example from the fan 100. This enables the bridge element 70, 71 to perform in this case the positioning of the heating arrangements 30, 31 in the housing 20, thus ensuring a functionally appropriate operation of the heating device 10.

Figure 8:
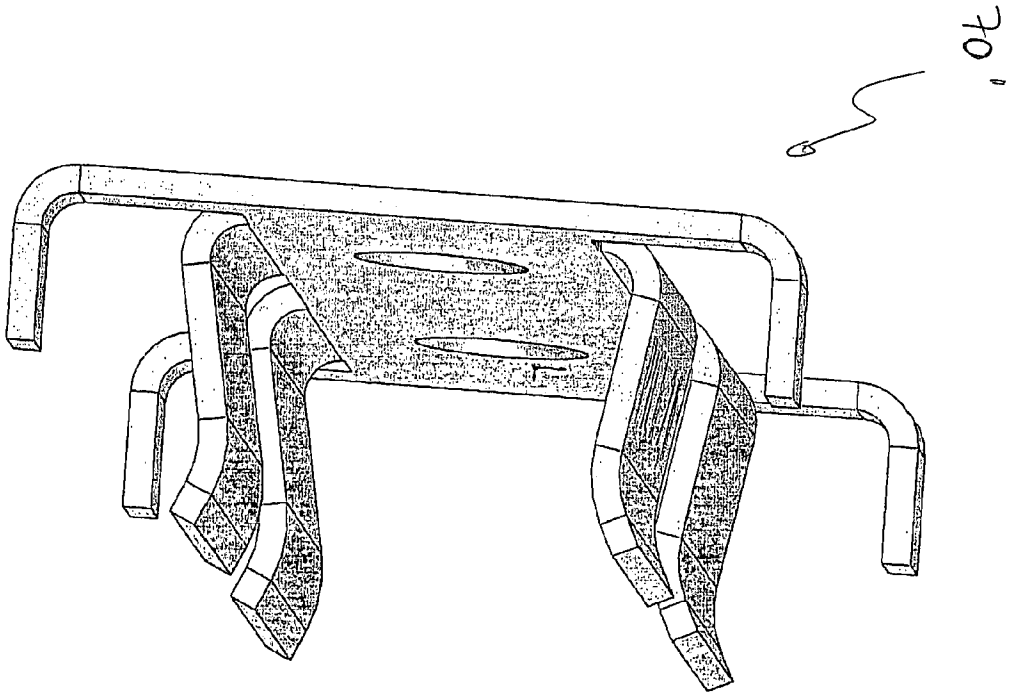
FIG. 8 shows a further configuration of a bridge element.

Another configuration of a bridge element, such as can also be used, is shown in FIG. 8. This element 70' fulfils the same function as that described above, although in this case the gripping arms are embodied in a curved manner. The curvature is configured in such a way that an insertion bevel is provided and the bridge element enters into engagement with the heating arrangements more easily. This facilitates the manufacturing process, in particular in automated operation.

The spacers 80, 81 arranged between the two heating arrangements 30, 31 are in this case embodied as further tensioning elements which counteract the bridge elements 70, 71. Grid elements 40, 41, 42, 43 and heating elements 50*a*, 50*b*, 50*c*, 50*d* are braced relative to one another by means of the tensioning elements (bridge elements, spacers) so that they touch in order in this way to ensure an optimum transfer of heat from the heating elements to the grid element and to substantially avoid play between the components.

The interaction of bridge element(s) 70, 71 and spacer(s) 80, 81 allows an optimum bracing of heating and grid elements relative to one another, the tensioning force being adjustable. Various types of spring can, for example, be used for this purpose. The exemplary embodiment shown here provides, for example, trough-like V-shaped metal sheets 80, 81, which press against the respective contact regions via the heating elements over the entire length thereof (linear contact). The bracing allows the use of higher temperatures than would be possible with an adhesive connection.

In order now to supply the heating elements 50*a*, 50*b*, 50*c*, 50*d* in each of the frame elements 60, 62 with power, power supply means 90, 91 are provided that comprise, according to FIGS. 2 and 3, connections connected to two of the grid elements 40, 42. The bracing of the elements relative to one another not only ensures an optimum transfer of heat, but also defines a path of the current. For this purpose, the spacers 80, 81 (V-shaped metal sheets) and the bridge elements 70, 71 are made of electrically conductive material. In order to allow functionally appropriate operation, PTC elements 50*a*, 50*b*, 50*c*, 50*d* of all the heating arrangements 30, 31 must be connected in parallel. In the embodiment shown here with two heating arrangements 30, 31, a respective power supply means (terminal) is arranged on the first and penultimate grid, as counted from the top down in the longitudinal direction. The path of the current therefore leads, on the one hand, from the top grid element 40 to the spacers 80, 81 via the upper PTC elements and the grid element 41 and, on the other hand, to the bottom grid element 43, to the lower PTC elements and then to the grid element 42 or to the spacers 80, 81 via the bridge elements. This may be seen from FIG. 4, in particular. The terminals of the power supply means 90, 91 are for example welded onto (for example using a spot welding apparatus), soldered onto or fastened to the grid elements by means of a crimping method or a riveting method.

Figure 4:
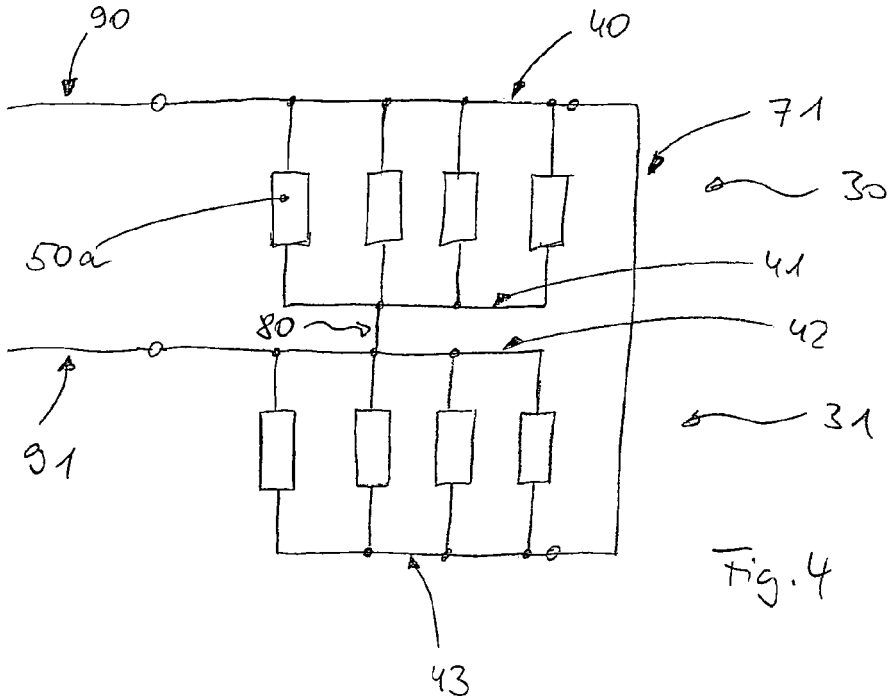
FIG. 4 is an equivalent circuit diagram showing a flow sheet for two sandwiched heating arrangements.

FIG. 4 is an equivalent circuit diagram corresponding to the embodiment as shown in FIGS. 2 and 3. The PTC elements are indicated as resistors connected in parallel (only reference numeral 50*a* is indicated here for one of the heating elements in a frame element). A power supply means (terminal) 90 is arranged on the first grid element and a further power supply means (terminal) 91 is arranged on the third and thus penultimate grid element 40, 42, as counted from the top down in the longitudinal direction. The bridge element 71 surrounds the circuit. The spacer 80 or 81 is indicated between the two heating arrangements 30, 31. The circuit is illustrated in simplified form. Thus, for example, there are indicated only one connecting line as the spacer and also only one bridge element.

The heating device could be implemented even using just one heating arrangement. Thus, power would be supplied via one grid element and removed again via the other. Bridge elements could, again, be provided as the tensioning element for holding the grid and heating elements together, although the bridge elements would then have to be made of electrically insulating material.

Figure 5:
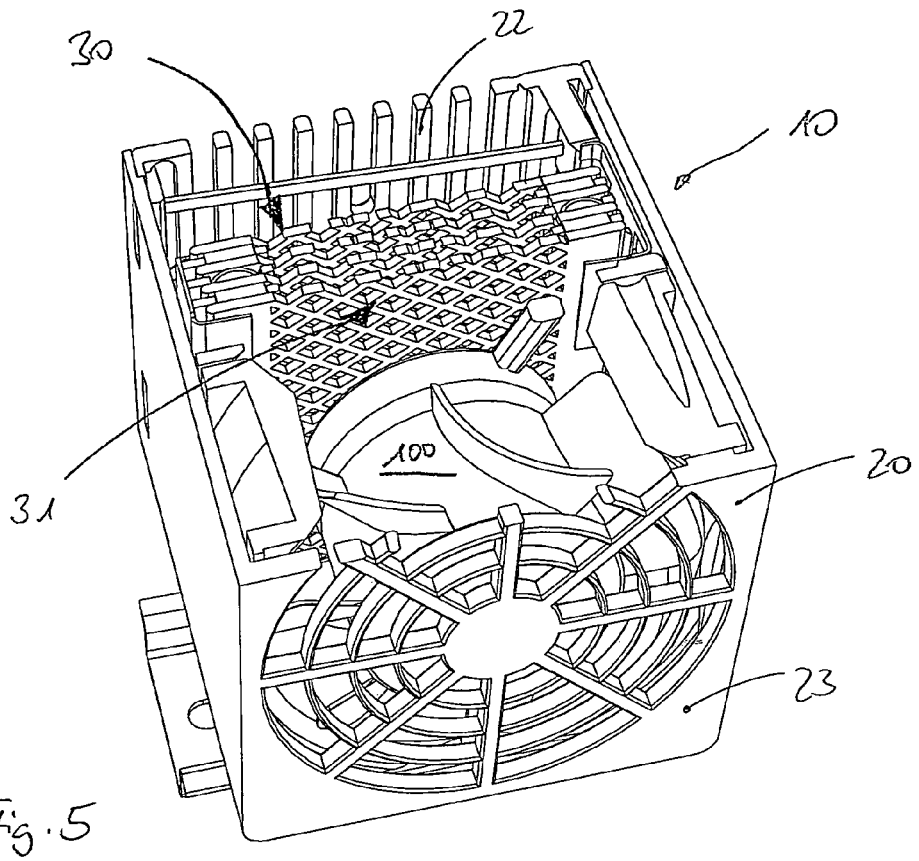
FIG. 5 is a perspective view from below of the embodiment according to FIG. 1.

FIG. 5 is a further perspective view of the embodiment according to FIG. 1, showing the lower protective grid 23. This figure also shows the housing 20 cut open, revealing the two heating arrangements 30, 31 and the fan 100.

Figure 6:
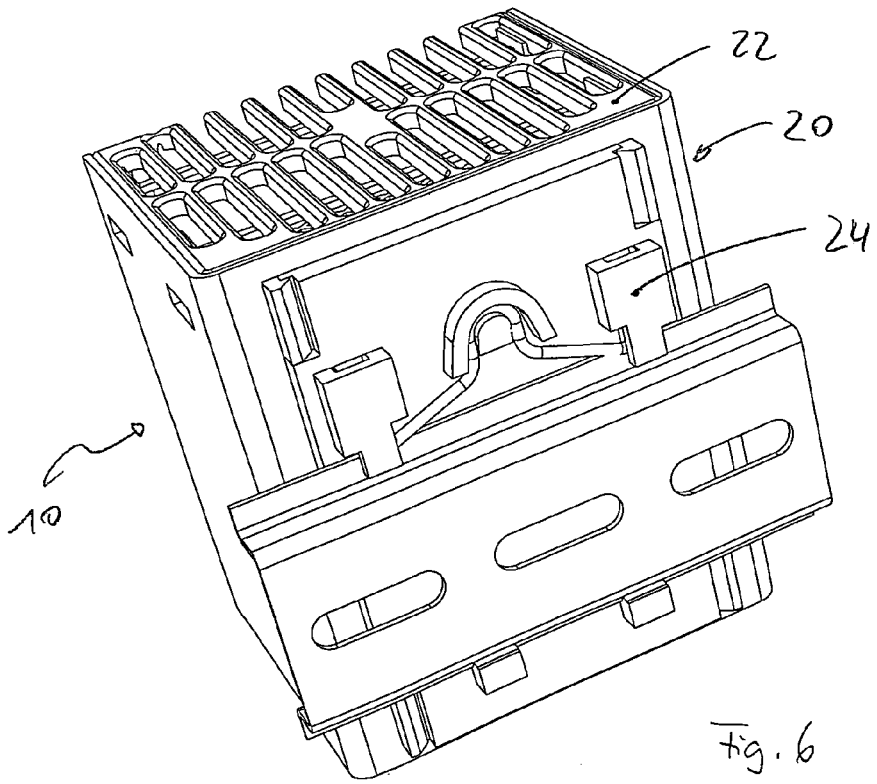
FIG. 6 is a perspective view from behind of the embodiment according to FIG. 1.

FIG. 6 is a further perspective view of the embodiment according to FIG. 1. The housing 20 is in this case shown from behind. The heating device 10 may be fastened to a rail located in a switch cabinet, for example, via hook elements 24 fastened to the housing 20. A clip fastening is also possible. The housing 20 is embodied in such a way that the heating device 10 can also be fastened from the side.

FIG. 7 shows a perforated grid having explicit contact regions 45*a*, 45*b* at the edges 47*a*, 47*b* of the grid element (for example 40). The heating elements rest against these contact regions, thus ensuring a good transfer of heat from the heating element to the grid or grids.

As a matter of principle, cooling elements can also be used instead of the heating elements, so that a cooling means is provided here.

It should be noted that the heating device (or else the heat exchanger) is embodied in such a way that the medium (i.e. for example air) flows substantially in the longitudinal direction through the housing, i.e. through the heating device. Of course, this wording is not intended to rule out the possibility that the flow of medium can be swirled (as described above). Swirling can and should cause the flow of medium to run at least partially and temporarily also in directions which do not run parallel to the longitudinal direction.

A heat exchanger, as has been described above, could for example be embodied as shown in FIGS. 2 and 3.

The heating device according to the invention having the heating arrangement described in the present document allows a space provided for this purpose to be heated in a simple manner, as in this case a high power density is possible as a result of controlled heating. The heating device is made of environmentally friendly materials and can be operated at low operating costs.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. Heating device, comprising at least one heating arrangement (30, 31), power supply means (90, 91) for supplying power to the heating arrangement (30, 31), a housing (20), through which in a longitudinal direction (L) a fluid medium can flow, for receiving the heating arrangement (30, 31), wherein the at least one heating arrangement comprises at least two grid elements (40, 41 or 42, 43) as heat exchanger plates with openings (44) through which the medium flows, the grid planes (46) of which are embodied for the exchange of heat energy between the plate and the fluid medium, at least one heating element (50, 51, 52, 53) arranged between the grid elements (40, 41 or 42, 43), wherein the at least one heating arrangement (30, 31) is arranged in the housing (20) in such a way that the grid planes (46) of the grid elements (40, 41, 42, 43) are arranged substantially perpendicularly to the longitudinal direction (L), so that the flow of medium is oriented substantially perpendicularly to the grid planes (46), wherein the grid elements (40, 41, 42, 43) and the at least one heating element (50, 51, 52, 53) are arranged braced relative to one another by means of at least one tensioning element (70, 71, 70', 80, 81) so that they touch, and wherein the grid elements (40, 41, 42, 43) each have at least one contact region (45*a*, 45*b*) and are arranged in such a way that they absorb the heat energy from the at least one heating element (50, 51, 52, 53) substantially via the contact region (45*a*, 45*b*), at least two heating arrangements (30, 31) are provided, wherein the heating arrangements are sandwiched on one another in such a way that the medium successively flows through them, wherein the heating elements (50, 51, 52, 53) and the at least one tensioning element (70, 71, 70', 80, 81) are arranged in such a way that the heating elements (50, 51, 52, 53) and contact regions (45*a*, 45*b*) are positioned one above another and are braced relative to one another beyond all of the heating arrangements (30, 31), and wherein the power supply means (90, 91) are arranged and embodied in such a way that the heating elements (50, 51, 52, 53) are connected in parallel.

2. Heating device according to claim 1, wherein a fan (100) is arranged in the housing (20) for generating the flow of medium.

3. Heating device according to claim 1, wherein the grid elements (40, 41, 42, 43) are made of electrically conductive material and the power supply means (90, 91) are embodied and arranged on the grid elements in such a way that the at least one heating element (50, 51, 52, 53) is powered via the grid elements (40, 41, 42, 43).

4. Heating device according to claim 1, further including at least one spacer (80, 81), which is preferably embodied in such a way that all the grid elements (40, 41, 42, 43) have substantially the same spacing from one another, is provided between the heating arrangements (30, 31).

5. Heating device according to claim 4, wherein at mutually opposing edges (47*a*, 47*b*) of the grid elements (40, 41, 42, 43) contact regions (45*a*, 45*b*) are provided and accordingly a large number of heating elements (50, 51, 52, 53) and if appropriate spacers (80, 81) are provided to form a stable stack of grid elements, heating elements and if appropriate spacers.

6. Heating device according to claim 1, further including a bridge element (70, 71, 70') embodied as a tensioning element in such a way that it surrounds the at least two heating arrangements (30, 31) and the grid elements (40, 41, 42, 43) and braces the heating elements (50, 51, 52, 53) relative to one another.

7. Heating device according to claim 6, wherein the bridge element (70, 71, 70') is embodied with spacer elements (72) in such a way that the at least one heating arrangement (30, 31) is fixable in the housing (20) and, set apart from the fan (100) and/or the housing (20), mountable therein.

8. Heating device according to claim 4, wherein the at least one spacer (80, 81) is embodied in a resilient manner to form an additional tensioning element.

9. Heating device according to claim 4, wherein the bridge element (70, 71, 70') and/or the at least one spacer (80, 81) are embodied as power supply means.

10. Heating device according to claim 4, wherein the at least one heating element (50, 51, 52, 53) and/or the grid elements (40, 41, 42, 43) and if appropriate the at least one spacer (80, 81) are mounted in receiving regions (63*a*, 63*b*, 63*c*) of a frame element (60, 61, 62), the receiving regions (63*a*, 63*b*, 63*c*) being embodied in such a way that the at least one heating element and/or the grid elements and if appropriate the at least one spacer are fixed substantially perpendicularly to the longitudinal direction (L) and arranged so as to be removable in the longitudinal direction (L), the at least one heating element and if appropriate the at least one spacer resting in the longitudinal direction (L) against the contact region (45*a*, 45*b*) of the grid elements (40, 41, 42, 43).

11. Heating device according to claim 10, wherein the frame element (60, 61, 62) is embodied with spacing elements (66*a*, 66*c*, 66*d*) in such a way that the at least one heating arrangement (30, 31), set apart from the housing (20), is mountable therein.

12. Heating device according to claim 1, wherein the grid element (40, 41, 42, 43) comprises an expanded metal grid and/or a punched grid.

13. Heating device according to claim 1, wherein the openings (44) in the wall regions surrounding or at least partially surrounding grid elements are oriented at least partially obliquely to the longitudinal direction (L).

14. Heating device according to claim 1, wherein partial portions of the grid elements are directed obliquely to the surface of the plate and thus to the direction of flow.

15. Heating device according to claim 1, wherein the grid elements (40, 41, 42, 43) have at least one contact region (45*a*, 45*b*) without openings.

16. Heating device according to claim 1, wherein the heating elements (50, 51, 52, 53) and the contact regions (45*a*, 45*b*) extend substantially over in each case the entire edge (47*a*, 47*b*) of the grid elements (40, 41, 42, 43).

17. Heat exchanger, comprising at least one heat or cold source (50*a*, 50*b*, 50*c*, 50*d*) for generating heat energy, and also at least one heat exchanger plate (40, 41, 42, 43), the surface (46) of which is embodied for the exchange of heat energy between the plate and a surrounding fluid medium, wherein the heat exchanger plate (40, 41, 42, 43) comprises an expanded metal grid, with openings (44) through which the medium flows, the at least one heat exchanger plate (40, 41, 42, 43) being arranged in such a way that the flow of medium is oriented substantially perpendicularly to the surface of the heat exchanger plate (40, 41, 42, 43).

* * * * *